US010477665B2

(12) United States Patent
Hadidi et al.

(10) Patent No.: US 10,477,665 B2
(45) Date of Patent: Nov. 12, 2019

(54) MICROWAVE PLASMA TORCH GENERATING LAMINAR FLOW FOR MATERIALS PROCESSING

(75) Inventors: Kamal Hadidi, Somerville, MA (US); Makhlouf Redjdal, Storrs-Mansfield, CT (US)

(73) Assignee: AMASTAN TECHNOLOGIES INC., North Andover, MA (US)

( * ) Notice: Subject to any disclaimer, the term of this patent is extended or adjusted under 35 U.S.C. 154(b) by 846 days.

(21) Appl. No.: 13/445,947

(22) Filed: Apr. 13, 2012

(65) Prior Publication Data

US 2013/0270261 A1 Oct. 17, 2013

(51) Int. Cl.
*H05B 6/64* (2006.01)
*H05H 1/30* (2006.01)

(52) U.S. Cl.
CPC ..... *H05H 1/30* (2013.01)

(58) Field of Classification Search
CPC .. B01J 19/126; C04B 35/443; C04B 35/6263; C04B 35/62665; C04B 35/645; C04B 35/6455; C04B 35/44; C04B 2235/3222; C04B 2235/3224; C04B 2235/3225; C04B 2235/528; C04B 2235/764; C01B 13/34; C01F 7/162; C01F 17/0025; C01P 2004/61; C01P 2002/02; C01P 2002/72; C01P 2004/03; C01P 2004/32; H05H 1/30
USPC ..... 219/686, 75, 121.48, 121.43, 121.41, 219/121.47, 121.51, 121.52, 121.54, 219/121.59, 687, 690; 204/298.37, 204/298.38; 315/111.21, 111.51; 313/231.31, 231.41; 356/316
See application file for complete search history.

(56) References Cited

U.S. PATENT DOCUMENTS 2,858,412 A * 10/1958 Kane et al. ..... 219/75
3,450,926 A * 6/1969 Kiernan ..... 313/231.41
3,562,486 A * 2/1971 Hatch et al. ..... 219/121.45
3,797,956 A * 3/1974 Bayer et al. ..... 408/35
(Continued)

OTHER PUBLICATIONS

Boulos, M. I., "The inductively coupled radio frequency plasma." Journal of High Temperature Material Process, 1997, vol. 1, pp. 17-39.

(Continued)

*Primary Examiner* — Eric S Stapleton
(74) *Attorney, Agent, or Firm* — Womble Bond Dickinson; Deborah M. Vernon; Heath T. Misley

(57) ABSTRACT

A microwave plasma torch providing two laminar flows is described. Two laminar flows are created using a set of at least three concentric, staggered dielectric tubes connected to a pressurized gas source. An inner laminar flow entrains injected particles entering the plasma. An outer laminar flow creates a sheath around the plasma and prevents it from attaching to the walls of the plasma torch. The entry point of the gas source is designed to ensure laminar flow for both the entrainment of the particles and for the shielding of the plasma plume. The uniform processing conditions results in uniform particles and a homogenous materials distribution. This enables a final product with improved thermal properties, improved corrosion and wear resistance and a higher tolerance to interface stresses. The microwave plasma torch can be used for producing nanomaterial powder and for spray coating materials onto various substrates.

13 Claims, 5 Drawing Sheets

(56) References Cited

U.S. PATENT DOCUMENTS 3,973,186 A * 8/1976 Uehara et al. ..... 324/636
RE29,304 E * 7/1977 Greenfield et al. ..... 356/316
4,060,708 A * 11/1977 Walters ..... 219/121.4
4,076,640 A 2/1978 Forgensi et al.
4,101,411 A * 7/1978 Suzuki et al. ..... 204/298.37
4,225,235 A * 9/1980 Anderson et al. ..... 356/316
4,266,113 A * 5/1981 Denton et al. ..... 219/121.51
4,390,772 A * 6/1983 Hiratake ..... 219/121.51
4,421,970 A * 12/1983 Couch, Jr. ..... 219/121.56
4,482,246 A * 11/1984 Meyer et al. ..... 356/316
4,551,609 A * 11/1985 Falk ..... 219/121.52
4,586,368 A * 5/1986 Rice et al. ..... 73/23.4
4,609,808 A * 9/1986 Bloyet et al. ..... 219/121.52
4,611,108 A * 9/1986 Leprince et al. ..... 219/121.48
4,659,899 A * 4/1987 Welkie et al. ..... 219/121.49
4,739,147 A * 4/1988 Meyer et al. ..... 219/121.48
4,766,287 A * 8/1988 Morrisroe et al. ..... 219/121.52
4,833,294 A * 5/1989 Montaser et al. ..... 219/121.52
5,010,220 A * 4/1991 Apte et al. ..... 219/686
5,083,004 A * 1/1992 Wells et al. ..... 219/121.5
5,087,434 A * 2/1992 Frenklach et al. ..... 423/446
5,132,512 A * 7/1992 Sanders et al. ..... 219/121.5
5,186,621 A * 2/1993 Pennington ..... 431/354
5,211,142 A * 5/1993 Matthews et al. ..... 123/143 B
5,317,126 A * 5/1994 Couch et al. ..... 219/121.51
5,345,079 A * 9/1994 French et al. ..... 250/288
5,349,154 A * 9/1994 Harker et al. ..... 117/102
5,578,108 A * 11/1996 Yamaguchi et al. ..... 75/336
5,734,143 A * 3/1998 Kawase et al. ..... 219/121.43
5,793,013 A * 8/1998 Read et al. ..... 219/121.48
5,909,277 A * 6/1999 Woskov et al. ..... 356/316
5,932,293 A * 8/1999 Belashchenko et al. ..... 427/446
5,958,361 A 9/1999 Laine et al.
5,961,870 A * 10/1999 Hogan ..... 219/679
5,973,289 A * 10/1999 Read et al. ..... 219/121.48
5,990,627 A * 11/1999 Chen et al. ..... 315/117
6,261,484 B1 * 7/2001 Phillips et al. ..... 264/5
6,274,110 B1 8/2001 Kim et al.
6,362,449 B1 * 3/2002 Hadidi et al. ..... 219/121.36
6,388,225 B1 * 5/2002 Blum et al. ..... 219/121.48
6,395,214 B1 * 5/2002 Kear et al. ..... 264/434
6,409,851 B1 * 6/2002 Sethuram et al. ..... 148/565
6,424,082 B1 * 7/2002 Hackett et al. ..... 313/231.31
6,543,380 B1 4/2003 Sung-Spitzl
6,569,397 B1 5/2003 Yadav et al.
6,652,822 B2 * 11/2003 Phillips et al. ..... 423/290
6,686,558 B2 * 2/2004 Selitser ..... 219/121.52
6,689,192 B1 * 2/2004 Phillips et al. ..... 75/342
6,693,253 B2 * 2/2004 Boulos et al. ..... 219/121.52
6,696,662 B2 * 2/2004 Jewett et al. ..... 219/121.48
6,734,385 B1 * 5/2004 Bark et al. ..... 219/121.48
6,755,886 B2 * 6/2004 Phillips et al. ..... 75/346
6,833,019 B1 * 12/2004 Lewis et al. ..... 75/345
6,902,745 B2 6/2005 Lee et al.
6,919,527 B2 * 7/2005 Boulos et al. ..... 219/121.52
6,936,787 B2 * 8/2005 Tao et al. ..... 219/121.51
6,982,395 B2 * 1/2006 Bayer et al. ..... 219/121.46
6,987,238 B2 * 1/2006 Horner-Richardson et al. ..... 219/121.51
6,994,837 B2 * 2/2006 Boulos et al. ..... 423/613
7,030,979 B2 * 4/2006 Hammer ..... 356/316
7,081,267 B2 * 7/2006 Yadav ..... 427/115
7,087,198 B2 * 8/2006 Hampden-Smith et al. ... 264/14
7,112,759 B1 * 9/2006 Severance, Jr. ..... 219/121.52
7,125,537 B2 10/2006 Liao et al.
7,175,786 B2 2/2007 Celikkaya et al.
7,220,398 B2 5/2007 Sutorik et al.
7,357,910 B2 * 4/2008 Phillips et al. ..... 423/592.1
7,374,704 B2 5/2008 Che et al.
7,381,363 B2 * 6/2008 Uesaka et al. ..... 266/103
7,381,382 B2 * 6/2008 Rabinovich et al. .... 422/186.22
7,453,566 B2 * 11/2008 Hadidi et al. ..... 356/316
7,494,527 B2 * 2/2009 Jurewicz et al. ..... 75/346
7,501,599 B2 * 3/2009 Boulos et al. ..... 219/121.36
7,524,353 B2 * 4/2009 Johnson et al. ..... 75/360
7,553,433 B2 * 6/2009 Hampden-Smith et al. ... 264/14
7,572,999 B2 * 8/2009 Tao et al. ..... 219/121.52
7,601,294 B2 * 10/2009 Ripley et al. ..... 266/202
7,615,097 B2 * 11/2009 McKechnie et al. ..... 75/346
7,629,553 B2 * 12/2009 Fanson et al. ..... 219/121.59
7,700,152 B2 4/2010 Laine et al.
7,833,011 B2 * 11/2010 Jonsson et al. ..... 431/79
7,847,210 B2 * 12/2010 Brezni et al. ..... 219/121.51
7,858,899 B2 * 12/2010 Fujii et al. ..... 219/121.48
7,910,048 B2 * 3/2011 Jurewicz et al. ..... 266/192
7,931,836 B2 4/2011 Xie et al.
7,967,891 B2 * 6/2011 Paserin et al. ..... 75/346
8,092,570 B2 * 1/2012 Boulos et al. ..... 75/10.19
8,211,388 B2 7/2012 Woodfield et al.
8,232,500 B2 * 7/2012 Brezni et al. ..... 219/121.48
8,268,230 B2 9/2012 Cherepy et al.
8,329,090 B2 12/2012 Hollingsworth et al.
2003/0083771 A1 * 5/2003 Schmidt ..... 700/119
2004/0009118 A1 1/2004 Phillips et al.
2005/0163696 A1 7/2005 Uhm et al.
2005/0210877 A1 * 9/2005 Rabinovich et al. ..... 60/643
2005/0242070 A1 11/2005 Hammer
2006/0145124 A1 7/2006 Hsiao et al.
2007/0029291 A1 * 2/2007 Boulos et al. ..... 219/121.59
2007/0130656 A1 6/2007 Boulos et al.
2007/0170377 A1 * 7/2007 Nakano ..... 250/504 R
2007/0175871 A1 * 8/2007 Brezni et al. ..... 219/121.52
2007/0259768 A1 11/2007 Kear et al.
2008/0006954 A1 1/2008 Yubuta et al.
2008/0055594 A1 * 3/2008 Hadidi et al. ..... 356/316
2008/0173641 A1 * 7/2008 Hadidi et al. ..... 219/690
2009/0093553 A1 4/2009 Kleine Jager et al.
2010/0176524 A1 7/2010 Burgess et al.
2012/0322645 A1 12/2012 Jordan et al.
2013/0270261 A1 10/2013 Hadidi et al.
2014/0155249 A1 6/2014 Hadidi et al.
2014/0217630 A1 8/2014 Redjdal et al.

OTHER PUBLICATIONS

Laine, R. M. et al., "Making nanosized oxide powders from precursors by flame spray pyrolysis." Key Engineering Materials (1999), v 159-160, p. 17-24.

Muoto, C. et al., "Phase Homogeneity in Y2O3—MgO Nanocomposites Synthesized by Thermal Decomposition of Nitrate Precursors with Ammonium Acetate Additions" J. Am. Ceram. Soc., 94[12] 4207-4217.

Veith et al., "Low temperature synthesis of nanocrystalline Y3Al5012 (YAG) and Cedoped Y3Al5012 via different sol-gel methods." J. Mater Chem, (1999) 9: 3069-3079.

* cited by examiner

MICROWAVE PLASMA TORCH GENERATING LAMINAR FLOW FOR MATERIALS PROCESSING

This invention was made with government support under Personal Service Agreement No. 6497 awarded by the Department of Defense/Navy/Office of Naval Research. The government has certain rights in the invention.

TECHNICAL FIELD

The present invention is generally directed to a microwave plasma torch used in materials processing. More particularly, the present invention is directed to a microwave plasma torch which generates laminar flow during materials processing. The laminar flow produced allows for the production of uniform particles and a homogenous materials distribution, which leads to improved characteristics in the final product. Even more particularly, the present invention is directed to a microwave plasma torch which can be used for nanomaterial powder production and for spray coating materials onto various substrates.

BACKGROUND OF THE INVENTION

When processing materials using a microwave plasma torch, a gas swirl flowing at high velocity prevents the plasma from attaching to the walls of the dielectric tube. This swirl gas subjects the materials to turbulent flow causing the materials to travel from the center of the tube, in line with the materials injection point, towards the surface of the tube wall, where the temperature is significantly lower than in the center of the tube. This subjects the materials to significantly asymmetrical temperature profiles and results in non-uniform particles and non-homogenous materials, which adversely affects the properties of the final product. Thus there is a need for a uniform processing environment for materials processed using microwave plasma. However, no such method has yet been reported.

From the above, it is therefore seen that there exists a need in the art to overcome the deficiencies and limitations described herein and above.

SUMMARY OF THE INVENTION

The shortcomings of the prior art are overcome and additional advantages are provided through the use of a plasma torch apparatus that is capable of producing laminar flow patterns.

In accordance with one embodiment of the present invention there is provided a method for producing laminar flow inside a plasma forming chamber while maximizing the entrainment velocity of injected particles used in materials processing. The present invention accomplishes this through the use of a plasma torch possessing several features.

The plasma torch of the present invention comprises a set of at least three staggered tubes fused together at one end. The lengths of the tubes are selected to provide laminar flow patterns for both particle entrainment and for protection from the plasma plume. The inner tube is the shortest and the outer tube is the longest. The length differential between the inner tube and the middle tube is chosen to provide a flow path for the gases so as to prevent turbulent flow effects from forming. A second laminar flow is also formed between the outer and middle tubes, which serves to protect the walls of the outer tube from contact with the plasma plume.

Another feature which promotes laminar flow is provided by gas injection ports which are angled relative to the central axis of the torch. This serves to ensure the uniformity in the laminar flow of gases inside the plasma torch.

Thirdly, the inner tube is tapered at the open end. This serves to reduce turbulent effects when the entrainment gas meets the injected particles at the open end of the inner tube.

A further feature of the current invention is that the spacing between the inner and middle tubes is selected so as to increase the entrainment velocity of the injected particles.

A source of microwave energy propagated by a waveguide is used to create a plasma plume at the open end of the middle tube. The maximum outside diameter of the outer tube is generally selected to be inversely proportional to the frequency of the microwave radiation.

Therefore, an object of the present invention is to provide a laminar flow environment, free of turbulent flow effects, for the material that goes through the plasma resulting in nanoparticles with uniform sizes and shapes and a homogenous materials distribution.

It is another object of the present invention to enhance plasma processing of materials so as to provide a product with improved thermal properties, improved corrosion and wear resistance and a higher tolerance to interface stresses.

It is still another object of the present invention to keep the tube walls cleaner.

It is also another object of the present invention to keep the tube walls cooler.

The microwave plasma torch described in this application can be used to produce nanomaterial powder and for the spray coating of materials onto various substrates.

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

Figure 1:
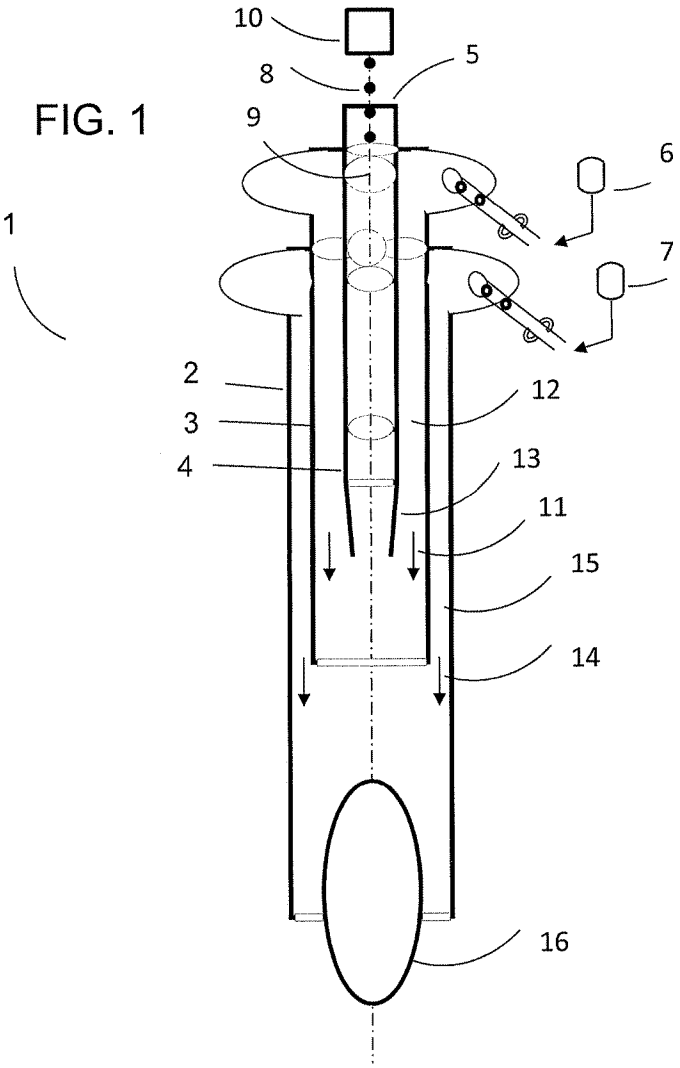
FIG. 1 illustrates a preferred embodiment of the plasma torch which uses staggered dielectric tubes to form the plasma torch used in materials processing, in accordance with the present invention.

Referring to FIG. 1, a microwave plasma torch apparatus 1 for materials processing, in accordance with a preferred embodiment of the present invention, includes three concentric dielectric tubes 2, 3, and 4. The tubes are fused together at one end and provide input 5 for particle injection, as well as inputs 6 and 7 for process gas flows. Input 5 into tube 4 is used to inject process particles 8 (exemplary particles shown), along an alignment axis 9, using injection apparatus 10, which can be a solid particle feeder, such as a powder feeder, or a high frequency droplet maker. These devices are well known in the plasma processing arts. Input 6 is a pressurized source that provides a core laminar flow 11 through narrow gap 12, which accelerates process particles 8 at open end of tube 4, with laminar entrainment taking place in tube 3. The width of gap 12 is chosen to shield the injected particles in 4 from high velocity flow 14 while at the same time maximizing the entrainment velocity of process particles 8. Turbulence in flow 11 is minimized through tapering end 13 of tube 4. Input 7 is a pressurized source that provides second laminar flow 14 through narrow gap 15, creating a laminar gas shroud at the open end of tube 3, which envelop plasma plume 16 and protects the inner wall of dielectric tube 2.

Figure 2:
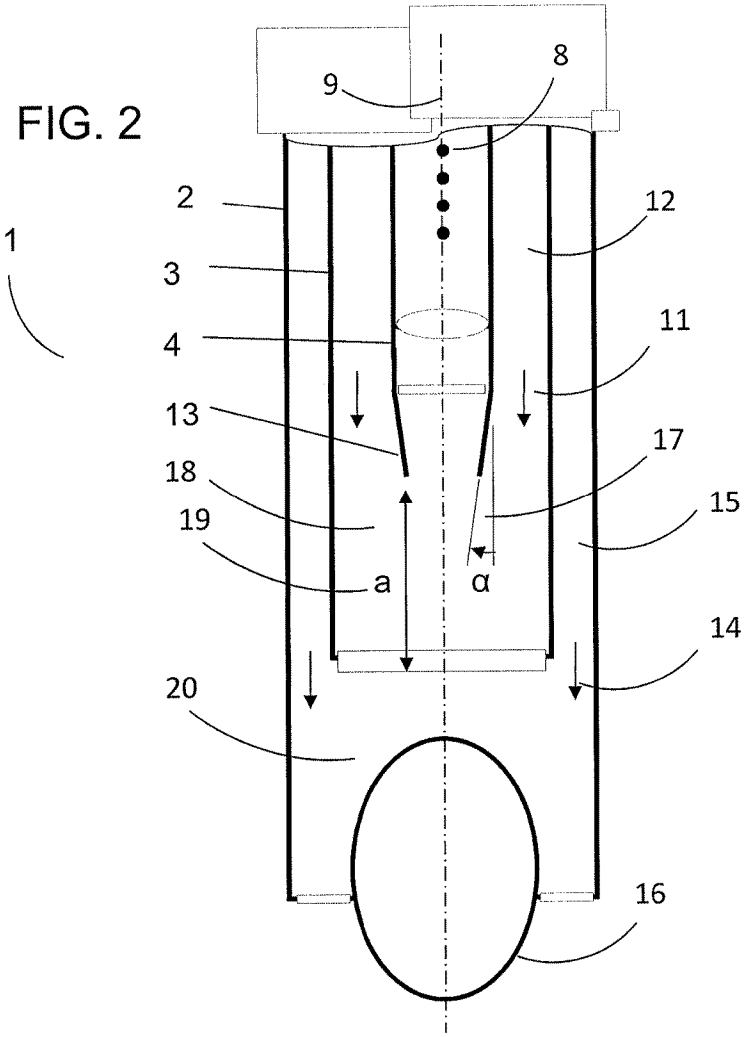
FIG. 2 illustrates details of the gas communication process which ensures uniform entrainment of process particles and the minimization of turbulence inside the plasma torch.

Referring to FIG. 2, dielectric torch 1 has characteristics to control gas flows in tubes 2 and 3 to ensure uniform thermal paths for particles 8 injected and guided through tube 4 along a central axis 9. Taper 13 is introduced at the end of tube 4 to minimize turbulence in gas flow 11 at the exit of gap 12 and to accelerate particles 8 in tube 4 through plasma 16. The tapering angle ($\alpha$) 17 can take any value between 0 and about 45° to ensure a smooth transition of gas flow 11 from annular gap 12 to the inside cylindrical volume 18 in tube 3. This creates a laminar flow for gas flow 11 to entrain particles 8 along a rectilinear path nearest to axis 9. The length 19, indicated as "a", of cylindrical volume 18 is preferably selected to be not less than one inch to ensure sufficient acceleration of particles 8 before entering hot zone 20.

Figure 3:
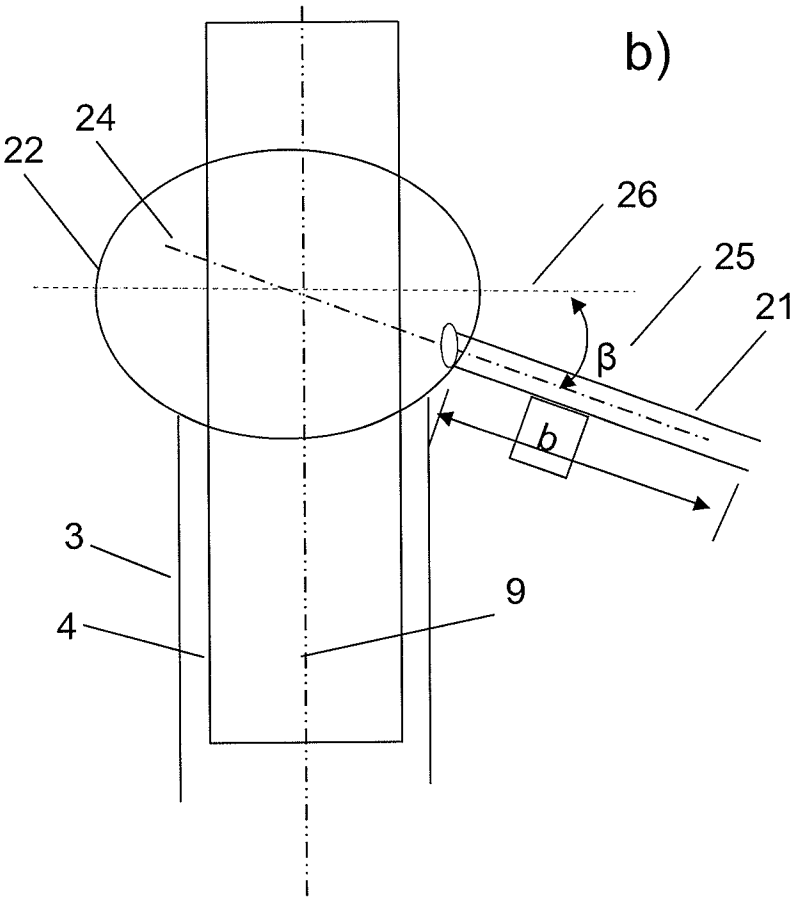
FIG. 3 illustrates a preferred embodiment of gas flow inputs into the plasma torch to ensure uniform laminar flow of gases inside the plasma torch.
Figure 3:
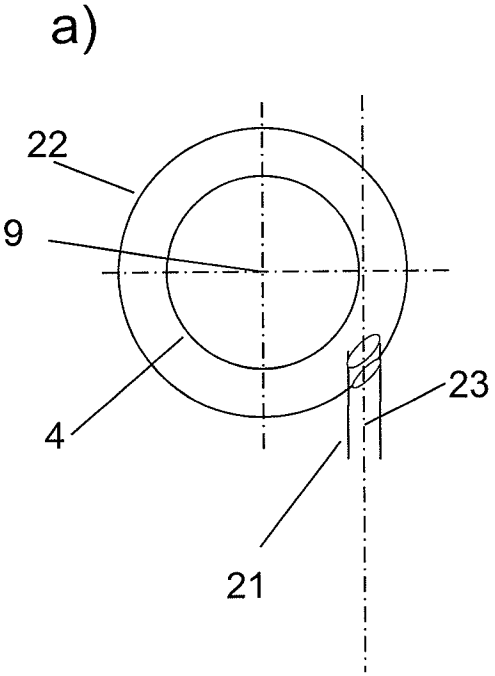

Referring to FIG. 3, there is illustrated a preferred embodiment for gas flow inputs to ensure stable laminar flows both for entrainment of particles 8 and for the symmetrical plasma flow in the hot zone of tube 2. Tube input 21 is sealed to gas chamber 22 along axis 23 as shown in FIG. 3*a* which shows a view from below of the gas bubble chamber 22. Axis 23 is off-center from central axis of injection 9 by a distance large enough so that flow of gas is substantially tangential to tube 4 or perpendicular to tube 4 but away from inner wall of gas bubble 22 so as to minimize generation of swirl flow inside gas chamber 22. The gas is subsequently carried all the way down the annular volume between tubes 3 and 4 towards the open end of the torch. In the side view FIG. 3*b*, tube 21 is shown sealed to gas chamber 22 along axis 24 making an angle $\beta$ 25 with plane 26. At this angle, the gas flow is directed toward the top of gas chamber 22 so that the gas distributes evenly before heading down the annular volume between tubes 3 and 4.

Figure 4:
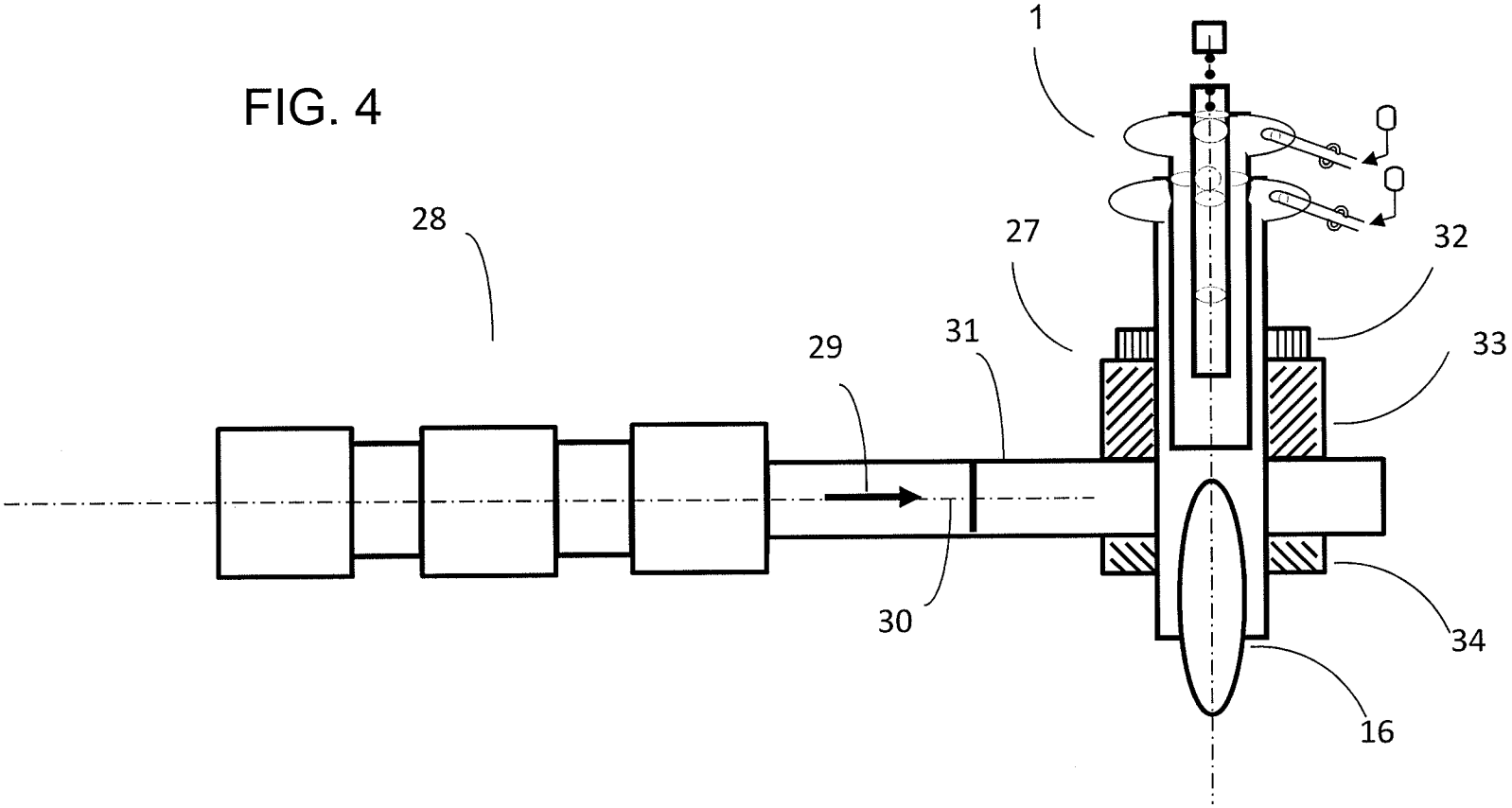
FIG. 4 illustrates a preferred embodiment of the plasma torch inside the plasma chamber which is part of a microwave plasma apparatus which produces plasma for materials processing.

Referring to FIG. 4, the plasma torch 1 is integrated into a plasma chamber 27, which forms part of a microwave generated plasma apparatus 28 that produces plasma 16 for materials processing. Plasma apparatus 28 is designed, in part, as discussed in published U.S. Patent Application 2008/0173641-A1 issued Jul. 24, 2008, hereby incorporated by reference, so that the microwave radiation 29 propagates substantially parallel to the axis 30 through the plasma chamber 27 which penetrates the waveguide 31.

Figure 5:
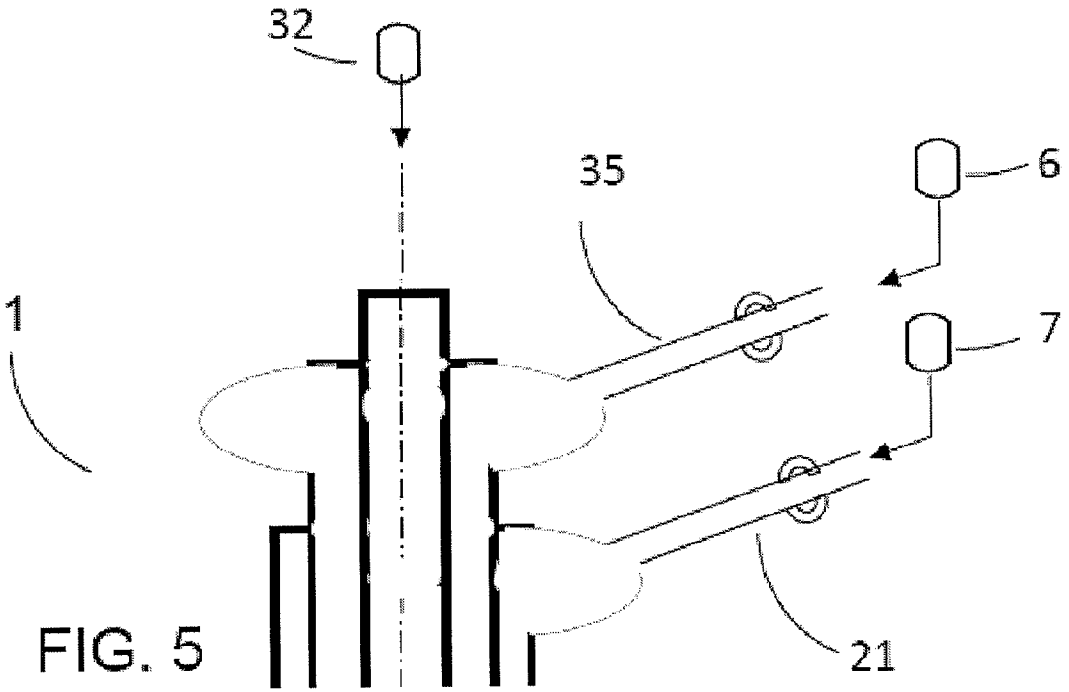
FIG. 5 illustrates details of using the plasma torch to process a combination of fluids using more than one particle feed source.

Referring to FIG. 5, plasma torch 1 can be used to process a combination of fluids using both particle source 32 and particle source 6. Gas source 7 is dedicated to gas flow which provides annular flow cooling to plasma torch 1. The gas flowing from gas source 7 can be air, individual components of air, an inert gas, a molecular gas, or any combination of gases. A multitude of fluids can be processed using plasma from particle source 6 and particle source 32. This mixing configuration of fluids includes processing any fluid flow from particle source 6 and processing any fluid flow from particle source 32.

While the invention has been described in detail herein in accordance with certain preferred embodiments thereof, many modifications and changes therein may be effected by those skilled in the art. Accordingly, it is intended by the appended claims to cover all such modifications and changes as fall within the spirit and scope of the invention.

What is claimed is:

1. A microwave plasma torch comprising:

a microwave radiation source for generating microwave radiation;

a set of concentric progressively smaller tubes comprising an outer tube, a middle tube, and an inner tube;

each of said tubes being manufactured of a dielectric material and each having an inlet end and an outlet end, each of said inlet ends facing in a first direction and each of said outlet ends facing in a diametrically opposite direction, wherein the outlet end of the middle tube extends beyond the outlet end of the inner tube and outlet end of the outer tube extends beyond the outlet end of the middle tube;

a first injection port for injecting gas between the outer tube and the middle tube;

a second injection port for injecting materials between the middle tube and the inner tube; and a waveguide positioned entirely downstream of the outlet end of the middle tube, the waveguide dimensioned and configured to guide microwave radiation between the microwave radiation source and an axial section of the outer tube between the outlet end of the middle tube and the outlet end of the outer tube.

2. The plasma torch of claim 1 wherein the dielectric material is comprised of fused quartz.

3. The plasma torch of claim 1 wherein said three tubes are fused together proximate to said inlet ends thereof.

4. The plasma torch of claim 1 wherein said inner tube is tapered toward a tube center axis at said outlet end at an angle relative to the tube center axis and the angle of taper being greater than 0 degrees and less than or equal to 45 degrees.

5. The plasma torch of claim 1 wherein said outlet end of said middle tube extends beyond said outlet end of said inner tube by at least 2.54 cm.

6. The plasma torch of claim 1 wherein the maximum outer diameter of said outer tube is no more than 3 cm when used with microwave radiation of frequency 2.45 GHz.

7. The plasma torch of claim 1 wherein the maximum outer diameter of said outer tube is no more than 9 cm when used with microwave radiation of frequency 915 MHz.

8. The plasma torch of claim 1 further including an apparatus for injecting solid, liquid, or gas phase materials into said inlet end of said inner tube along the axis thereof toward said outlet end thereof.

9. The plasma torch of claim 1 wherein said second injection port is dimensioned and configured for accommodation of a material selected from the group consisting of solid, liquid and gas.

10. The plasma torch of claim 1 wherein said injection port comprising:

a substantially spherical or ellipsoidal bubble fused immediately above said inlet of said middle tube or said outer tube;

an inlet tube which is fused to said bubble; and said bubble and said inlet tube are made of the same material as said concentric tubes.

11. The plasma torch of claim 10 wherein the axis of said inlet tube is at an angle relative to a plane that is perpendicular to the central axis of said concentric tubes.

12. The plasma torch of claim 11 wherein said angle is between 0.5 degrees and 45 degrees.

13. The plasma torch of claim 1 further comprising a third injection port for injecting materials into the inner tube.

* * * * *